US009234418B2

(12) United States Patent
Rayssiguier

(10) Patent No.: US 9,234,418 B2
(45) Date of Patent: Jan. 12, 2016

(54) SELF-TIGHTENING CLAMPS TO SECURE TOOLS ALONG THE EXTERIOR DIAMETER OF A TUBING

(75) Inventor: Christophe M Rayssiguier, Melun (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 687 days.

(21) Appl. No.: 13/483,056

(22) Filed: May 30, 2012

(65) Prior Publication Data

US 2012/0312552 A1 Dec. 13, 2012

Related U.S. Application Data

(60) Provisional application No. 61/491,426, filed on May 31, 2011.

(51) Int. Cl.

| | |
|---|---|
| ***E21B 47/01*** | (2012.01) |
| ***E21B 19/12*** | (2006.01) |
| ***E21B 17/02*** | (2006.01) |
| ***E21B 17/10*** | (2006.01) |

(52) U.S. Cl.

CPC ..... *E21B 47/01* (2013.01); *E21B 17/023* (2013.01); *E21B 17/1035* (2013.01); *E21B 19/12* (2013.01); *Y10T 29/49947* (2015.01)

(58) Field of Classification Search

CPC ... E21B 17/105; E21B 17/1035; E21B 19/12; E21B 47/01

USPC ..... 166/380, 241.7, 378; 138/110

See application file for complete search history.

(56) References Cited

U.S. PATENT DOCUMENTS

| | | | | |
|---|---|---|---|---|
| 4,042,023 | A * | 8/1977 | Fox | 166/241.7 |
| 4,543,998 | A * | 10/1985 | Thomerson | 138/110 |
| 4,603,737 | A * | 8/1986 | Spikes | 166/241.7 |
| 5,598,995 | A | 2/1997 | Meuth et al. | |
| 6,957,704 | B2 | 10/2005 | Rogers et al. | |
| 7,339,494 | B2 | 3/2008 | Shah et al. | |
| 7,398,697 | B2 | 7/2008 | Allen et al. | |
| 7,595,737 | B2 | 9/2009 | Fink et al. | |
| 2003/0226662 | A1 | 12/2003 | Linyaev et al. | |
| 2010/0326671 | A1 | 12/2010 | Buytaert et al. | |

FOREIGN PATENT DOCUMENTS

| | | |
|---|---|---|
| GB | 2185574 | 7/1987 |

OTHER PUBLICATIONS

International Search Report for the equivalent PCT patent application No. PCT/IB2012/052735 issued on Sep. 12, 2013.

* cited by examiner

*Primary Examiner* — Nicole Coy
(74) *Attorney, Agent, or Firm* — Cameron R. Sneddon

(57) ABSTRACT

A clamp assembly is disclosed. The clamp assembly is made with a first clamp part, a second clamp part, a hinge assembly and a fastener. The first clamp part has at least one connection capable of receiving and securing the at least one downhole tool. The first clamp part also has a first inner clamp surface. The second clamp part has a second inner clamp surface extending between the third side and the fourth side. The hinge assembly connects a first side of the first clamp part to a third side of the second clamp part and is configured to permit the first clamp part and the second clamp part to be moved to a closed position and an open position to receive the tubing.

22 Claims, 10 Drawing Sheets

SELF-TIGHTENING CLAMPS TO SECURE TOOLS ALONG THE EXTERIOR DIAMETER OF A TUBING

CROSS-REFERENCE TO RELATED APPLICATIONS

The present application is based on and claims priority to U.S. Provisional Patent Application No. 61/491,426, filed May 31, 2011.

TECHNICAL FIELD

This invention relates generally to mechanical clamps to secure a device externally to a tubing used in oil and gas wells or the like. More particularly, but not by way of limitation, the present invention relates to a clamp assembly, with self-tightening features offering enhanced resistance to an axial load, for attaching downhole tools such as an acoustic modem which transmits and receives data and control signals between a location down a borehole and the surface, or between downhole locations themselves.

BACKGROUND ART

One of the more difficult problems associated with any borehole is to communicate measured data between one or more locations down a borehole and the surface, or between downhole locations themselves. For example, in the oil and gas industry it is desirable to communicate data generated downhole to the surface during operations such as drilling, perforating, fracturing, and drill stem or well testing; and during production operations such as reservoir evaluation testing, pressure and temperature monitoring. Communication is also desired to transmit intelligence from the surface to downhole tools or instruments to effect, control or modify operations or parameters.

Accurate and reliable downhole communication is particularly important when complex data comprising a set of measurements or instructions is to be communicated, i.e., when more than a single measurement or a simple trigger signal has to be communicated. For the transmission of complex data it is often desirable to communicate encoded analog or digital signals. These transmissions can be performed through direct wire connection between the surface and the downhole location(s) or through wireless communications techniques such as electromagnetic waves, pressure or fluid pulses, and acoustic communication.

A tubing is composed of many pipes linked together by connections. There are few nominal sizes for the outside diameter (for example 2⅞ inches, 3.5 inches or 4.5 inches). The outside diameter has a rather large tolerance which is defined by norms edited by the American Petroleum Institute. The connection between pipes, which may be called a "coupling", comprises a thread, and a very large variety of connections exist on the present market. Most of the time, the coupling outside diameters are larger than a diameter of the pipe.

When a device, such as a sensor (temperature, pressure) or a transmitter (for example acoustic transmitter) must be secured on the pipe, such device can either be installed in a carrier (also called a mandrel) placed between two pieces of pipe (see for example, U.S. Pat. No. 7,339,494) or it can be clamped directly along the outside diameter of the pipe, using one or several mechanical collars called "clamps". Usually, the prior art clamps are made of at least two parts which are secured together so that they can be directly installed on the tubing, without engaging the connections.

However, a tool secured outside of the tubing can be exposed to large axial loads and shock when the pipe is moving inside an open hole (whose rugged surface can generate a high friction force when dragging), or when the tool engages a liner. The liner, for example, may be a casing of smaller size located in a lower part of a well. Therefore, the liner forms an abrupt change in diameter with the upper casing. When the tool is an acoustic modem, such acoustic modem has a transceiver assembly which vibrates to introduce axial stress waves into the tubing. In this instance, the acoustic modem should be securely connected to the tubing to maximize the signal transferred from the acoustic modem into the tubing.

As discussed above, clamps are often used for attaching downhole communications tools and/or wires to a downhole pipe. Clamps are well known in the art and take the form of hinged friction collars, hinged collars with set screws, and hinged collars with dogs. See for example, U.S. Pat. No. 6,957,704.

The hinged collar described in the '704 patent has two semicircular bands which are joined at one end by a hinge. At the opposite ends from the hinge, the semicircular bands have a flange through which a bolt extends. Thus, the hinged style stop collar is attached to a pipe by spreading the semicircular bands wide enough to receive the pipe. Rotating about the hinge, the semicircular bands are closed together until a bolt can be inserted through the flanges and tightened. As the bolt tightens, the flanges are drawn closer together so as to squeeze the collar about the pipe.

Moreover, as described/shown in the '704 patent, the hinged collar with set screws also comprises two semicircular bands which together surround a pipe. In this case, however, both ends of both semicircular bands have a hinge. The hinge is made up of corresponding eyelet pieces which are joined by a pin. Thus, the collar is attached to a pipe by placing the semicircular bands on opposite sides of the pipe and mating the hinge eyelets at the ends of the bands. With the hinge eyelets properly mated, pins are inserted into the eyelets. The semicircular bands also comprise set screws which are used to tighten the collar on the pipe. The set screws extend in a radial direction through the bands toward the pipe.

Hinged collars with dogs are again made of two semicircular bands which mate with each other to extend about the circumference of a pipe. Rather than eyelets, two ends of the semicircular bands are joined by interlocking fingers. The opposite ends of the bands have flanges through which a bolt extends. As the bolt is tightened, the flanges are drawn closer together so as to squeeze the bands around the circumference of the pipe. This collar also has several dogs which extend radially through the bands to provide protrusions or bulges on the interior of the bands for engagement with the casing. As the bolt is tightened and the bands are squeezed about the circumference of the pipe, the dogs firmly engage the outer surface of the pipe.

Prior art clamps generally rely on friction to stay in position. Usually made from carbon steel, the surface finish of a pipe can vary with rust and other imperfections. When friction clamps are secured on a rusty surface, resistance to axial load pressures is lowered because rust has low shearing characteristics.

Techniques have been proposed to enhance a shear coupling between a housing of a transmitter assembly and a wall of a tubular string. For example, U.S. Pat. No. 7,595,737 discloses a transmitter assembly of an acoustic telemetry system which is shear coupled to the wall of the tubular string.

To enhance the shear coupling between the housing and the wall of the tubular string, external mating surfaces of the housing and the wall may be roughened, serrated, etc. to provide increased grip therebetween.

Clamps with a hinge located on one side of the pipe have uneven distribution of the load, biased to the side of the pipe on which the bolts are located. The load is lesser on the hinge side because most of the force has been absorbed by the friction between the clamp and the pipe.

Pipe diameter varies, because tolerances for pipe diameter are large. Clamps must be capable of fitting even the largest pipe diameter. Prior art clamps contact the pipe mainly on two lines located in the center plane, placing pressure on relatively small areas of the pipe 180° from each other. The pipes, having relatively thin walls, can be deformed into an oval shape.

Despite the efforts of the prior art, there exists a need for a clamp assembly adapted to include improved contact with pipe material, even distribution of load, and more contact points with the pipe. It is therefore desirable to provide an improved clamp assembly with better load bearing, load distribution, and pipe contact features. It is to such a clamp assembly to the present disclosure is directed.

BRIEF DISCLOSURE OF THE INVENTION

In one version, the present disclosure describes a clamp assembly for connecting at least one downhole tool to a tubing in a well. The tubing has an exterior surface. The clamp assembly is provided with a first clamp part, a second clamp part, a hinge assembly and a fastener.

The first clamp part has a first end and a second end. The first end has at least one connection capable of receiving and securing the at least one downhole tool. The first clamp part has a first side and a second side extending between the first end and the second end. The first clamp part also has a first inner clamp surface extending between the first side and the second side, and a first external surface extending between the first side and the second side.

The second clamp part has a third end, a fourth end, a third side, and a fourth side with the third side and the fourth side extending between the third end and the fourth end. The second clamp part also has a second inner clamp surface extending between the third side and the fourth side, and a second external surface extending between the third side and the fourth side.

The hinge assembly connects the first side to the third side and is configured to permit the first clamp part and the second clamp part to be moved to a closed position where the second side is positioned adjacent to the fourth side and an open position where the second side and the fourth side are spaced a distance apart to receive the tubing.

The fastener connects the second side to the fourth side when the first clamp part and the second clamp part are in the closed position. The first inner clamp surface and the second inner clamp surface are sized and dimensioned to grip the exterior surface of the tubing when the first clamp part and the second clamp part are in the closed position. Further, the hinge assembly and the fastener are adapted to permit longitudinal movement between 1/32 of an inch and 1/4 of an inch of the first clamp part relative to the second clamp part to form a self-tightening action.

In one aspect, the first clamp part includes a bore extending between the first end and the second end, and wherein the hinge assembly includes a pin positioned within the bore and a plurality of bolts connecting the pin to the third side.

In another aspect, the first side defines a plurality of fingers forming a space between each adjacent pair of fingers to form a series of fingers and spaces, and wherein the bolts are positioned within the spaces. In this aspect, the third side may include a series of counter-bores with each counter-bore being aligned with one of the spaces.

In yet another aspect, the first inner clamp surface includes a slot extending between the first end and the second end to form a first clamp zone and a second clamp zone. The connection can be in close proximity to the first clamp zone. The second inner clamp surface may also include a slot extending between the third end and the fourth end.

In yet another aspect, the first inner clamp surface includes a plurality of teeth extending in a direction from the first side to the second side wherein the teeth are projections adapted to cut into the tubing to form a shear coupling between the first inner clamp surface and the tubing. Similarly, the second inner clamp surface may also include a plurality of teeth extending in a direction from the third side to the fourth side wherein the teeth are projections adapted to cut into the tubing to form a shear coupling between the second inner clamp surface and the tubing.

In a further aspect, the hinge assembly includes a plurality of first bolts connecting the first side to the third side, and the fastener includes a plurality of second bolts connecting the second side to the fourth side when the first clamp part and the second clamp part are in the closed position.

The first external surface of the first clamp part and the second external surface of the second clamp part are preferably sized such that the first clamp part and the second clamp part fit within a downhole casing when the first clamp part and the second clamp part are in the closed position.

In another version, the present disclosure describes an apparatus, comprising a downhole tool having a first end and a second end; and two clamp assemblies with a first one of the clamp assemblies connected to the first end of the downhole tool and a second one of the clamp assemblies connected to the second end of the downhole tool. The first one and the second one of the clamp assemblies comprise a first clamp part and a second clamp part.

The first clamp part has a first end, a second end, a first side and a second side with the first side and the second side extending between the first end and the second end. The first clamp part has a first inner clamp surface extending between the first side and the second side, and a first external surface extending between the first side and the second side.

The second clamp part has a third end, a fourth end, a third side, and a fourth side with the third side and the fourth side extending between the third end and the fourth end. The second clamp part also has a second inner clamp surface extending between the third side and the fourth side, and a second external surface extending between the third side and the fourth side.

The hinge assembly connects the first side to the third side and is configured to permit the first clamp part and the second clamp part to be moved to a closed position where the second side is positioned adjacent to the fourth side and an open position where the second side and the fourth side are spaced a distance apart to receive a tubing.

The fastener connects the second side to the fourth side when the first clamp part and the second clamp part are in the closed position. The first inner clamp surface and the second inner clamp surface are sized and dimensioned to grip an exterior surface of a tubing positionable within a well when the first clamp part and the second clamp part are in the closed position. The hinge assembly and the fastener are adapted to permit longitudinal movement between 1/32 of an inch and 1/4 of an inch of the first clamp part relative to the second clamp part to form a self-tightening action.

In another aspect, the first clamp part and the second clamp part are in the closed position and wherein the apparatus further comprises a tubing positioned between the first clamp part and the second clamp part.

In another version, the present disclosure describes a method of connecting a downhole tool to a tubing within a well. Two clamp assemblies as discussed above are connected to opposite ends of the downhole tool with the connections in the first clamp parts. Then, the two clamp assemblies are connected to an exterior surface of the tubing.

In yet another version, the present disclosure describes a method of making a clamp assembly. In this version, a first side of a first clamp part is connected to a third side of a second clamp part via a hinge assembly adapted to permit longitudinal movement of the first clamp part relative to the second clamp part between 1/32 of an inch and 1/4 of an inch. The first clamp part and the second clamp part define first and second inner clamp surfaces sized and adapted to grip a tubing within a wellbore. A fastener is connected to a second side of the first clamp part, the fastener configured to connect the second side of the first clamp part to a fourth side of the second clamp part to permit longitudinal movement between 1/32 of an inch and 1/4 of an inch of the first clamp part relative to the second clamp part.

In an aspect, the first clamp part includes a bore extending between a first end and a second end, and wherein the step of connecting the first side of the first clamp part to the third side of the second clamp part includes the steps of positioning a pin within the bore and connecting a plurality of bolts to the pin.

In another aspect, the first side defines a plurality of fingers forming a space between each adjacent pair of fingers to form a series of fingers and spaces, and wherein the bolts are positioned within the spaces.

In yet another aspect, a series of counter-bores are formed in the second clamp part with each of the counter-bores being aligned with one of the spaces.

In a further aspect, a slot is formed in the first inner clamp surface extending between a first end and a second end to form a first clamp zone and a second clamp zone, and a slot is formed in the second inner clamp surface extending between a third end and a fourth end to form a third clamp zone and a fourth clamp zone.

BRIEF DESCRIPTION OF THE DRAWINGS

Certain embodiments of the present invention will hereafter be described with reference to the accompanying drawings, wherein like reference numerals denote like elements, and.

DETAILED DESCRIPTION

Figure 1:
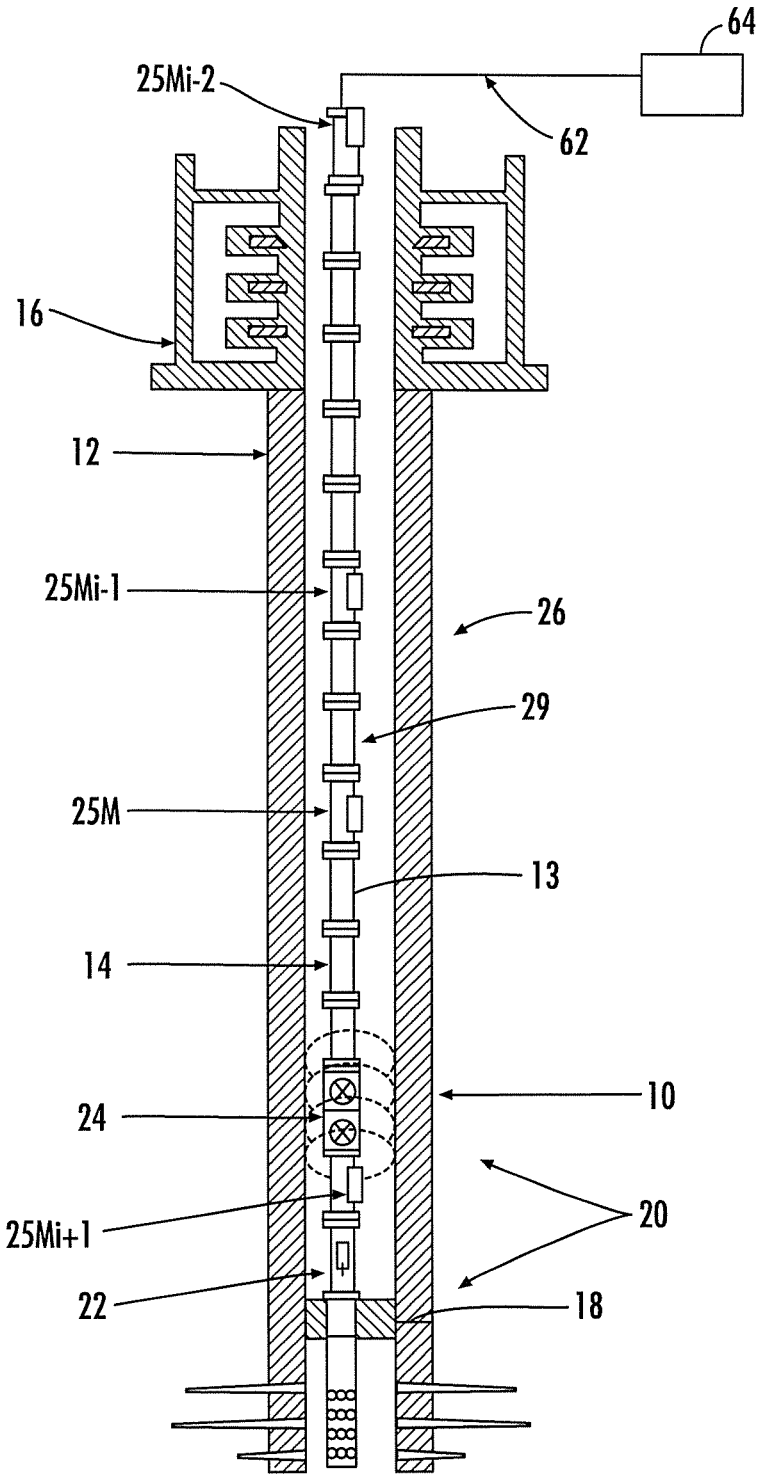
FIG. 1 shows a schematic view of an acoustic telemetry system according to an embodiment of the present invention.

The present invention is particularly applicable to testing installations such as are used in oil and gas wells or the like. FIG. 1 shows a schematic view of such a system. Once a well 10 has been drilled through a formation, the drill string can be used to perform tests, and determine various properties of the formation through which the well has been drilled. In the example of FIG. 1, the well 10 has been lined with a steel casing 12 (cased hole) in the conventional manner, although similar systems can be used in unlined (open hole) environments. In order to test the formations, it is preferable to place testing apparatus in the well close to the regions to be tested, to be able to isolate sections or intervals of the well, and to convey fluids from the regions of interest to the surface. This is commonly done using a jointed tubular drill pipe, drill string, production tubing, sections thereof, or the like (collectively, tubing 14) which extends from well-head equipment 16 at the surface down inside the well 10 to a zone of interest. The well-head equipment 16 can include blow-out preventers and connections for fluid, power and data communication.

A packer 18 is positioned on the tubing 14 and can be actuated to seal the borehole around the tubing 14 at the region of interest. Various pieces of downhole test equipment (collectively, downhole equipment 20) are connected to the tubing 14 above or below the packer 18. Such downhole equipment 20 may be referred to herein as one or more downhole tool and may include, but is not limited to: additional packers; tester valves; circulation valves; downhole chokes; firing heads; TCP (tubing conveyed perforator) gun drop subs; samplers; pressure gauges; downhole flow meters; downhole fluid analyzers; and the like.

In the embodiment of FIG. 1, a sampler 22 is located above the packer 18 and a tester valve 24 is located above the packer 18. The downhole equipment 20 may be connected to an acoustic modem 25Mi+1 which can be mounted using at least two clamp assemblies 28*a* and 28*b* (see FIG. 3) positioned between the sampler 22 and the tester valve 24. The acoustic modem 25Mi+1, operates to allow electrical signals from the downhole equipment 20 to be converted into acoustic signals for transmission to the surface via the tubing 14, and to convert acoustic tool control signals from the surface into electrical signals for operating the downhole equipment 20. The term "data," as used herein, is meant to encompass control signals, tool status, and any variation thereof whether transmitted via digital or analog signals.

Figure 2:
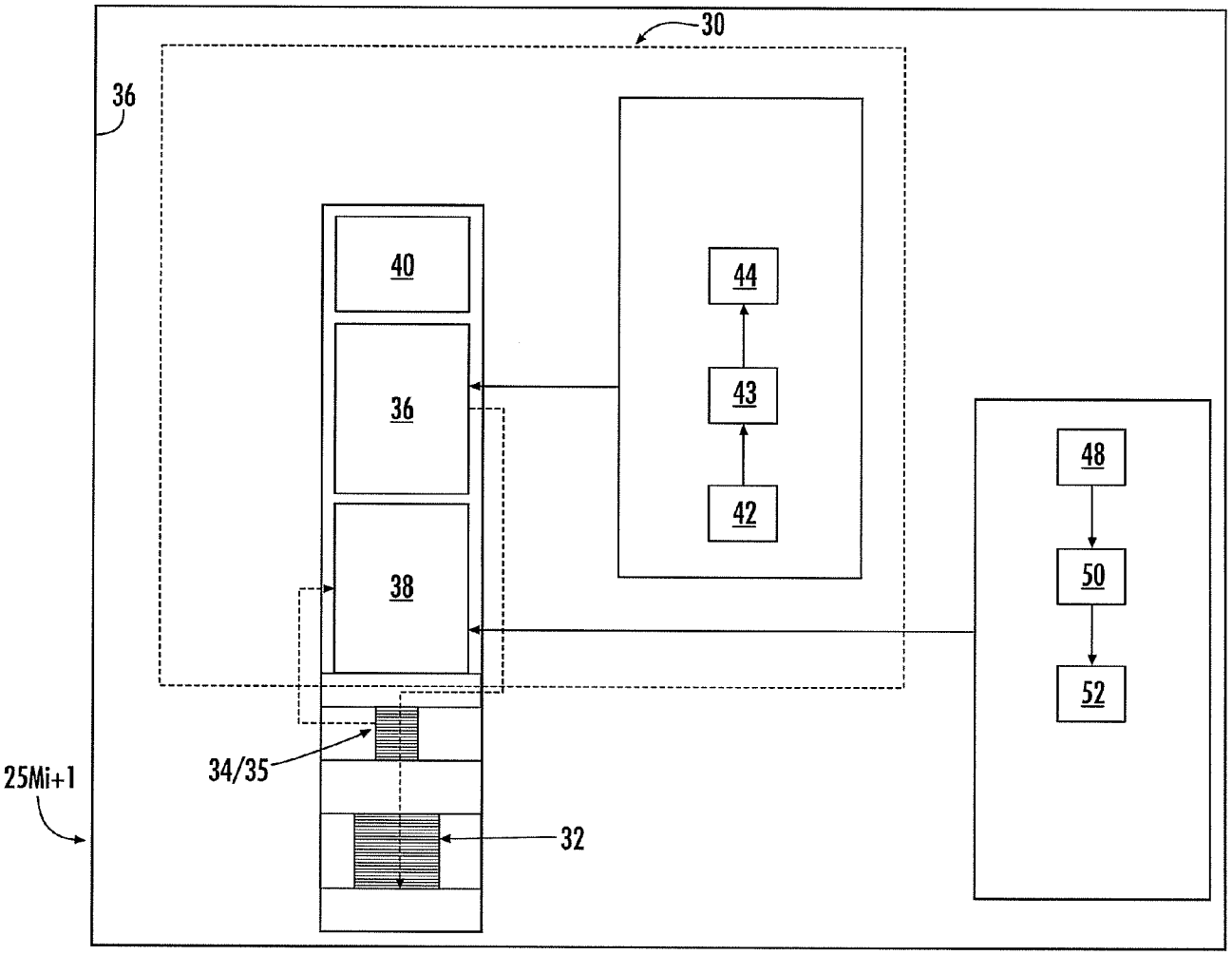
FIG. 2 shows a schematic of an acoustic modem as used in accordance with the embodiment of FIG. 1.

FIG. 2 shows a schematic of the acoustic modem 25Mi+1 in more detail. The acoustic modem 25Mi+1 comprises a housing 30 supporting a transceiver assembly 32 which can be a piezo electric actuator or stack, and/or a magnetorestrictive element which can be driven to create an acoustic signal in the tubing 14. The acoustic modem 25Mi+1 can also include an accelerometer 34 and/or an additional transceiver assembly 35 for receiving acoustic signals. Where the acoustic modem 25Mi+1 is only required to receive acoustic messages, the transceiver assembly 32 may be omitted. The acoustic modem 25Mi+1 also includes transmitter electronics 36 and receiver electronics 38 located in the housing 30 and power is provided by means of a battery, such as a lithium battery 40. Other types of power supply may also be used.

The transmitter electronics 36 are arranged to initially receive an electrical output signal from a sensor 42, for example from the downhole equipment 20 provided from an electrical or electro/mechanical interface. Such signals are typically digital signals which can be provided to a microcontroller 43 which modulates the signal in one of a number of known ways PSK, QPSK, QAM, and the like. The microcontroller 43 can be implemented as a single micro-controller or two or more micro-controllers working together. In any event, the resulting modulated signal is amplified by either a linear, or non-linear, amplifier 44 and transmitted to the transceiver assembly 32 so as to generate an acoustic signal (which is also referred to herein as an acoustic message) in the material of the tubing 14.

The acoustic signal passes along the tubing 14 as a longitudinal and/or flexural wave comprises a carrier signal with an applied modulation of the data received from the sensors 42. The acoustic signal typically has, but is not limited to, a frequency in the range 1-10 kHz, preferably in the range 2-5 kHz, and is configured to pass data at a rate of, but is not limited to, about 1 bps to about 200 bps, preferably from about 5 to about 100 bps, and more preferably about 50 bps. The data rate is dependent upon conditions such as the noise level, carrier frequency, Inter Symbol Interference and the distance between the acoustic modems 25Mi−2, 25Mi−1, 25M and 25Mi+1. A preferred embodiment of the present disclosure is directed to a combination of a short hop acoustic modems 25Mi−1, 25M and 25Mi+1 for transmitting data between the surface and the downhole equipment 20, which may be located above and/or below the packer 18. The acoustic modems 25Mi−1 and 25M can be configured as repeaters of the acoustic signals. The system may be designed to transmit data as high as 200 bps. Other advantages of the present system exist.

The receiver electronics 38 of the acoustic modem 25Mi+1 are arranged to receive the acoustic signal passing along the tubing 14 produced by the transmitter electronics 36 of the acoustic modem 25M. The receiver electronics 38 are capable of converting the acoustic signal into an electric signal. In a preferred embodiment, the acoustic signal passing along the tubing 14 excites the transceiver assembly 32 so as to generate an electric output signal (voltage); however, it is contemplated that the acoustic signal may excite the accelerometer 34 or the additional transceiver assembly 35 so as to generate an electric output signal (voltage). This signal is essentially an analog signal carrying digital information. The analog signal is applied to a signal conditioner 48, which operates to filter/condition the analog signal to be digitalized by an A/D (analog-to-digital) converter 50. The A/D converter 50 provides a digitalized signal which can be applied to a microcontroller 52. The microcontroller 52 is preferably adapted to demodulate the digital signal in order to recover the data provided by the sensor 42, or provided by the surface. The type of signal processing depends on the applied modulation (i.e. PSK, QPSK, OFDM, QAM, and the like).

The acoustic modem 25Mi+1 can therefore operate to transmit acoustic data signals from sensors 42 in the downhole equipment 20 along the tubing 14. In this case, the electrical signals from the downhole equipment 20 are applied to the transmitter electronics 36 (described above) which operate to generate the acoustic signal. The acoustic modem 25Mi+1 can also operate to receive acoustic control signals to be applied to the downhole equipment 20. In this case, the acoustic signals are demodulated by the receiver electronics 38 (described above), which operate to generate the electric control signal that can be applied to the downhole equipment 20.

Returning to FIG. 1, in order to support acoustic signal transmission along the tubing 14 between the downhole location and the surface, a series of the acoustic modems 25Mi−1 and 25M, etc. may be positioned along the tubing 14. The acoustic modem 25M, for example, operates to receive an acoustic signal generated in the tubing 14 by the acoustic modem 25Mi−1 and to amplify and retransmit the signal for further propagation along the tubing 14. The number and spacing of the acoustic modems 25Mi−1 and 25M will depend on the particular installation selected, for example on the distance that the signal must travel. A typical spacing between the acoustic modems 25Mi−1, 25M, and 25Mi+1 is around 1,000 ft, but may be much more or much less in order to accommodate all possible testing tool configurations. When acting as a repeater, the acoustic signal is received and processed by the receiver electronics 38 and the output signal is provided to the microcontroller 52 of the transmitter electronics 36 and used to drive the transceiver assembly 32 in the manner described above. Thus an acoustic signal can be passed between the surface and the downhole location in a series of short hops.

The role of a repeater is to detect an incoming signal, to decode it, to interpret it and to subsequently rebroadcast it if required. In some implementations, the repeater does not decode the signal but merely amplifies the signal (and the noise). In this case the repeater is acting as a simple signal booster. However, this is not the preferred implementation selected for wireless telemetry systems of the present invention.

The acoustic modems 25M, 25Mi−1, 25Mi−2, and 25Mi+2 will either listen continuously for any incoming signal or may listen from time to time.

The acoustic wireless signals, conveying commands or messages, propagate in the transmission medium (the tubing 14) in an omni-directional fashion, that is to say up and down. It is not necessary for the acoustic modem 25Mi+1 to know whether the acoustic signal is coming from the acoustic modem 25M above or an acoustic modem 25Mi+2 (not shown) below. The direction of the acoustic message is preferably embedded in the acoustic message itself. Each acoustic message contains several network addresses: the address of the acoustic modem 25Mi−1, 25M or 25Mi+1 originating the acoustic message and the address of the acoustic modem 25Mi−1, 25M or 25Mi+1 that is the destination. Based on the addresses embedded in the acoustic messages, the acoustic modem 25Mi−1 or 25M functioning as a repeater will interpret the acoustic message and construct a new message with updated information regarding the acoustic modem 25Mi−1, 25M or 25Mi+1 that originated the acoustic message and the destination addresses. Acoustic messages will be transmitted from acoustic modem 25Mi−1 to 25M and may be slightly modified to include new network addresses.

Referring again to FIG. 1, the acoustic modem 25Mi−2 is provided at surface, such as at or near the well-head equipment 16 which provides a connection between the tubing 14 and a data cable or wireless connection 62 to a control system 64 that can receive data from the downhole equipment 20 and provide control signals for its operation.

In the embodiment of FIG. 1, the acoustic telemetry system is used to provide communication between the surface and a section of the tubing 14 located downhole.

Clamp Assembly

Figure 3:
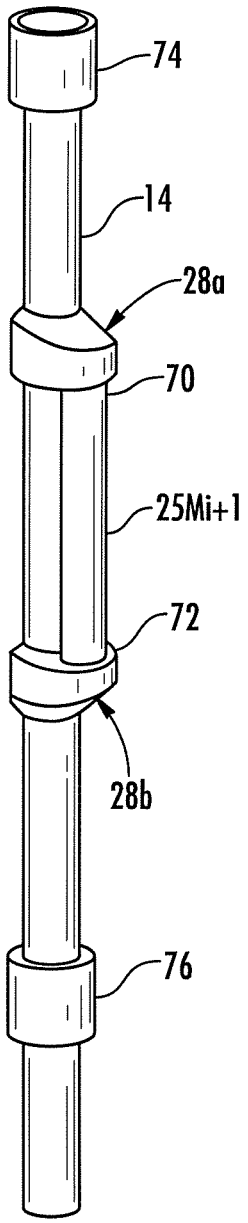
FIG. 3 is a perspective view of a section of a tubing having a tool connected to the tubing with two clamp assemblies constructed in accordance with the present disclosure.
Figure 13:
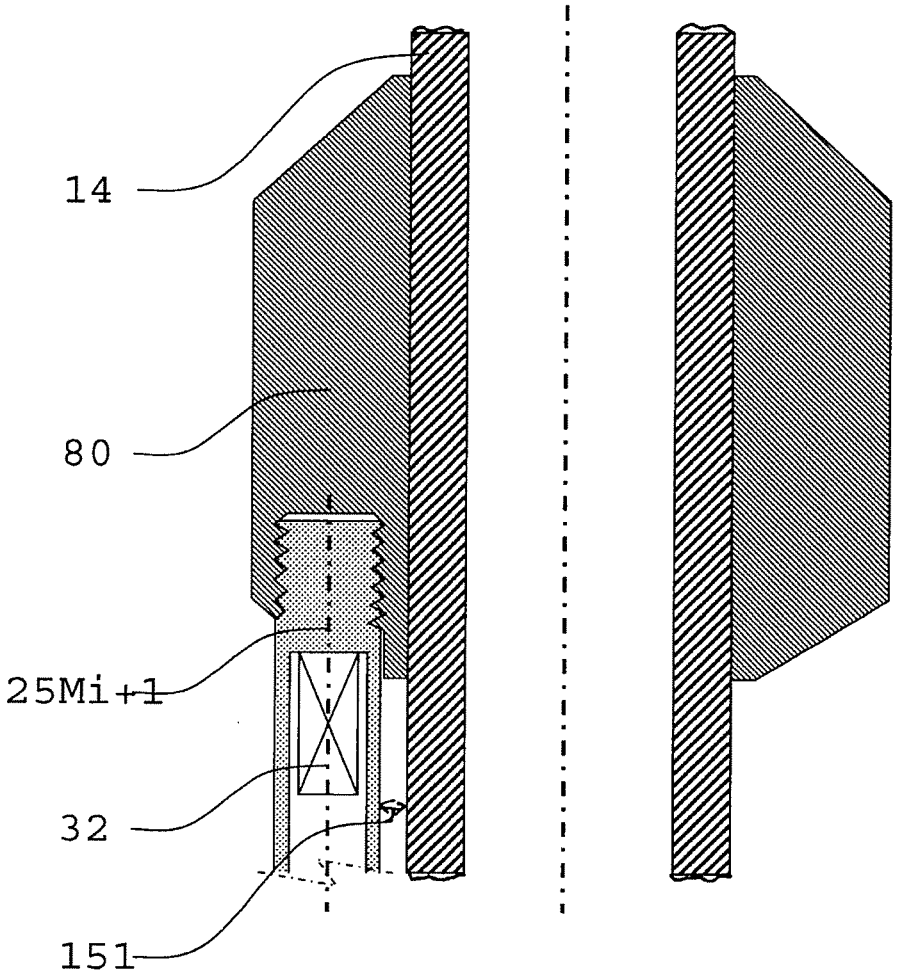
FIG. 13 is a diagrammatic view of one of the clamp assemblies connected to the tubing showing an acoustic modem spaced a distance away from the tubing.

Referring now to FIG. 3, shown therein is an apparatus 69. The apparatus 69 includes clamp assemblies 28*a* and 28*b* and the downhole tool 20, which can be and will be described as the acoustic modem 25Mi+1 by way of example. The apparatus 69 optionally includes a section of the tubing 14 and a downhole supporting the acoustic modem 25Mi+1. The acoustic modem 25 Mi+1 is connected to the tubing 14 utilizing the clamp assemblies 28*a* and 28*b*, as discussed above. In particular, the acoustic modem 25Mi+1 can be spaced a distance away from the tubing 14 and is provided with a first end 70, and a second end 72. The first end 70 of the acoustic modem 25Mi+1 is connected to the clamp assembly 28*a*, and the second end 72 of the acoustic modem 25Mi+1 is connected to the clamp assembly 28*b*. It should be noted that the section of the tubing 14 includes a first connection 74, and a second connection 76. The acoustic modem 25Mi+1 as well as the clamp assemblies 28*a* and 28*b* are positioned on the tubing 14 preferably such that the clamp assemblies 28*a* and 28*b* are spaced a distance away from and preferably not in contact with the first connection 74 and the second connection 76 to form a gap 151. In this example and as shown in FIG. 13, the acoustic modem 25Mi+1 preferably does not directly contact the tubing 14 and there is not a shear connection directly between the acoustic modem 25Mi+1 and the tubing 14. As will be discussed below, the apparatus 69 may include a shear connection between the clamp assemblies 28*a* and 28*b* and the tubing 14.

Figure 4A:
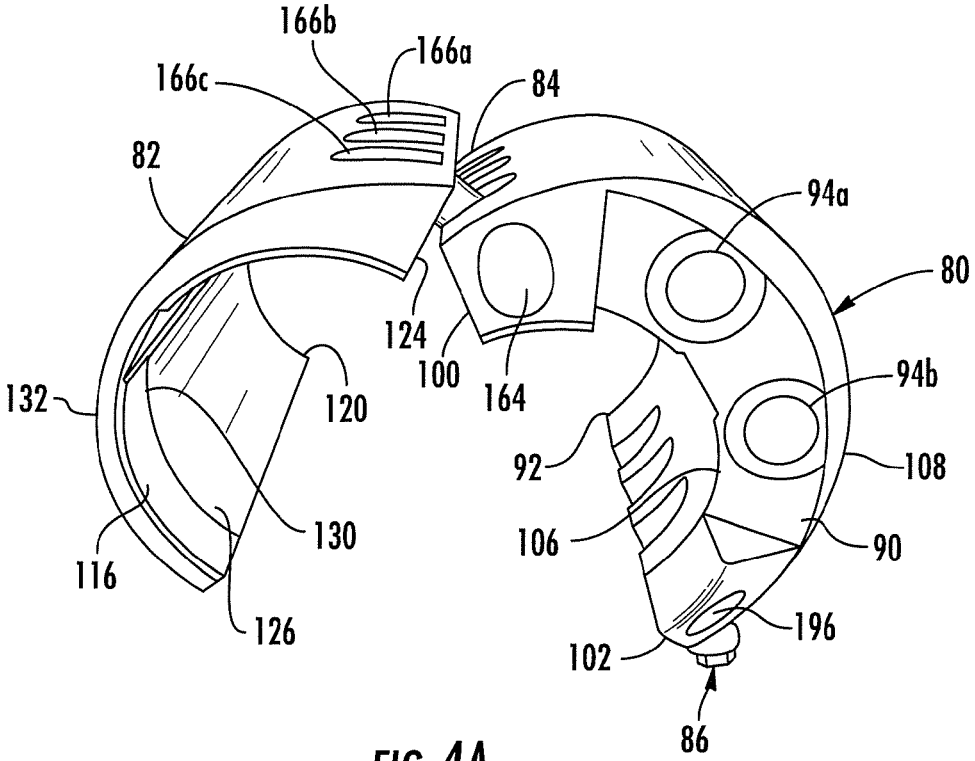
FIG. 4A is a perspective view of one of the clamp assemblies depicted in FIG. 3.
Figure 5:
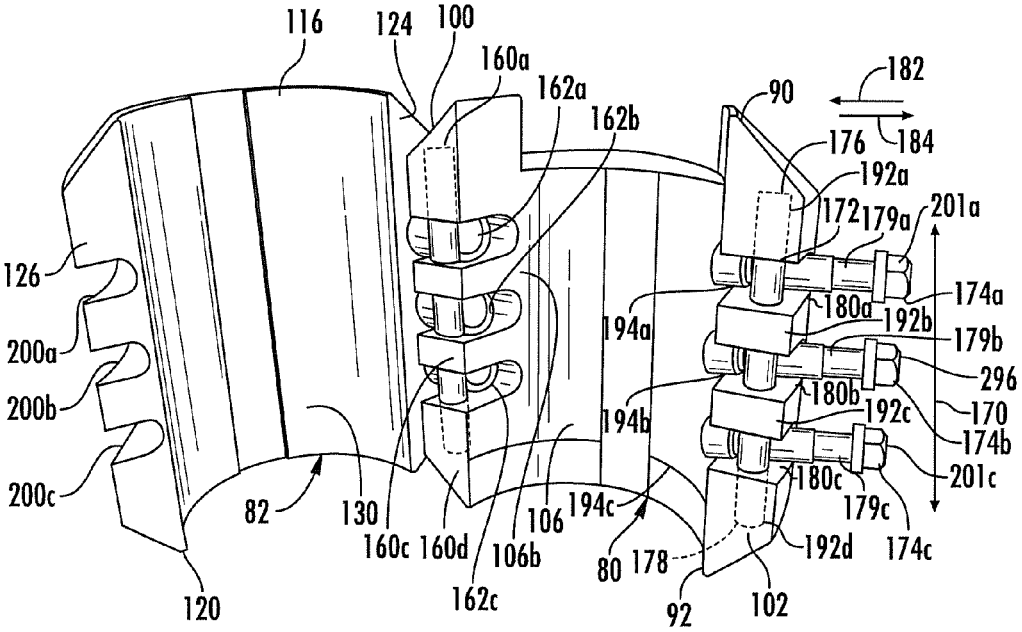
FIG. 5 is another perspective view of the clamp assembly depicted in FIG. 4A showing inner clamp surfaces defined by clamp parts of the clamp assembly.
Figure 6:
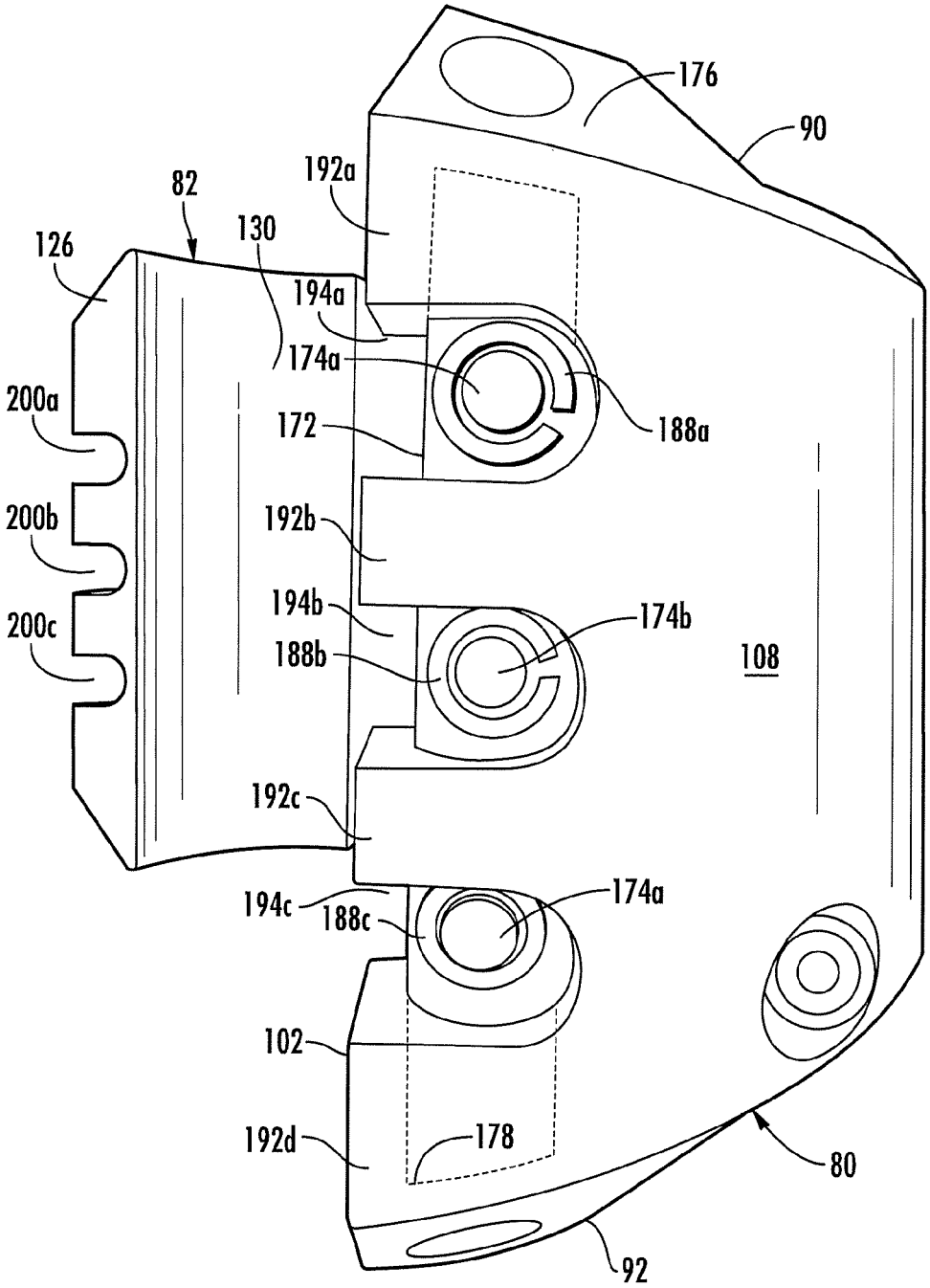
FIG. 6 is an elevational view showing an exemplary fastener of the clamp assembly depicted in FIGS. 4A and 5.

Referring now to FIGS. 4A, 5 and 6, shown therein is an exemplary clamp assembly 28, which can be either one of the clamp assemblies 28*a* and 28*b*. The clamp assembly 28 serves to connect one or more downhole tool 20 to the tubing 14, which is disposed in the well 10. The clamp assembly 28 is provided with a first clamp part 80, and a second clamp part 82. The first clamp part 80, and the second clamp part 82 are connected together to form a one-piece unit with a hinge assembly 84 and a fastener 86. The clamp assembly 28 is attached to the tubing 14 by spreading the first clamp part 80 and second clamp part 82 with the hinge assembly 84 and then connecting the opposite ends together with the fastener 86 once the clamp assembly 28 is positioned on the tubing 14.

The first clamp part 80 has a first end 90, and a second end 92. The first end 90 of the first clamp part 80 has at least one connection 94 capable of receiving and securing the at least one downhole tool 20. As shown in FIG. 4A, the first clamp part 80 can be provided with two connections 94*a* and 94*b* each of which is capable of securing the downhole tool 20, such as a threaded hole or a shoulder. The connections 94*a* and 94*b* is a device that mechanically joins two or more objects together and may include a threaded hole or an unthreaded hole with a recess so that the downhole tool 20 can be secured by a nut.

Either one of the connection 94*a* and the connection 94*b* rigidly connect the acoustic modem 25Mi+1 to the clamp assemblies 28*a* and 28*b*. The clamp assemblies 28*a* and 28*b* rigidly connect to the tubing 14. In this manner, the transceiver assembly 32 located in the acoustic modem 25Mi+1 close to the connection and exerting a vertical force parallel to a tubing axis, is also exerting the same vertical force on the clamp assemblies 28*a* and 28*b* and on the tubing 14, allowing for extensional wave propagation. In a reciprocal manner for the reception mode, the vertical displacement of the tubing 14 associated with the incoming extensional wave is transmitted to the clamp assemblies 28*a* and 28*b* and to the acoustic modem 25Mi+1 preferably without distortion, allowing for a receiving sensor (such as an accelerometer) located within the acoustic modem 25Mi+1 to detect this displacement. For the force to be transmitted through the clamp assemblies 28*a* and 28*b* to the tubing 14 preferably without distortion, or for the displacement to be transmitted from the tubing 14 to the acoustic modem 25Mi+1 preferably without distortion, the clamp assemblies 28*a* and 28*b* move like a rigid body and are free of resonances in the frequency range of operations.

The first clamp part 80 is also provided with a first side 100 and a second side 102. As will be discussed in more detail below, the first side 100 is connected to the hinge assembly 84 while the second side 102 is connected to the fastener 86. The first clamp part 80 is also provided with a first inner clamp surface 106 extending between the first side 100 and the second side 102; and a first external surface 108 also extending between the first side 100 and the second side 102.

The second clamp part 82 has a third end 116, and a fourth end 120. The second clamp part 82 is also provided with a third side 124, and a fourth side 126. The third side 124 and the fourth side 126 extend between the third end 116 and the fourth end 120. The second clamp part 82 also has a second inner clamp surface 130 extending between the third side 124 and the fourth side 126; and a second external surface 132 also extending between the third side 124 and the fourth side 126 generally opposite that of the second inner clamp surface 130.

As shown in FIG. 4A, for example, the first inner clamp surface 106 and the second inner clamp surface 130 are dimensioned and shaped so as to grip the exterior surface of the tubing 14. In one embodiment, the first inner clamp surface 106 and the second inner clamp surface 130 can be semi-cylindrically shaped. The first clamp part 80 and second clamp part 82 are sized and dimensioned so as to fit within the borehole, and in particular, the first external surface 108 and the second external surface 132 cooperate to form a substantially cylindrical shape.

Figure 7:
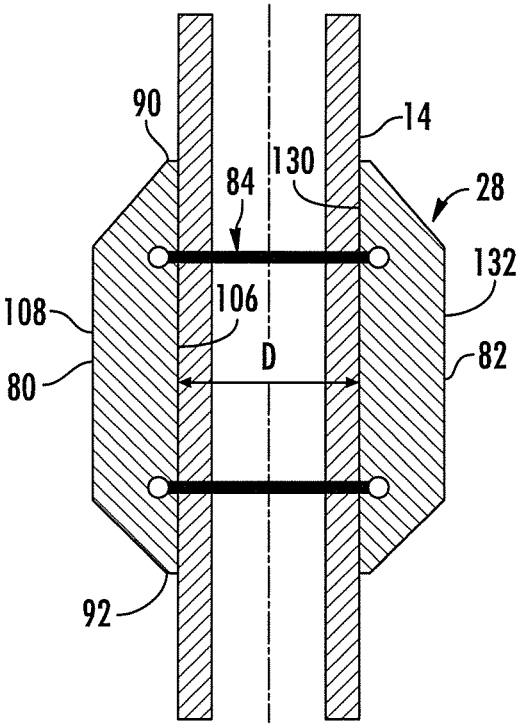
FIG. 7 is a diagrammatic view illustrating one of the clamp assemblies installed on the tubing prior to axial stress being applied to the clamp assembly.
Figure 8:
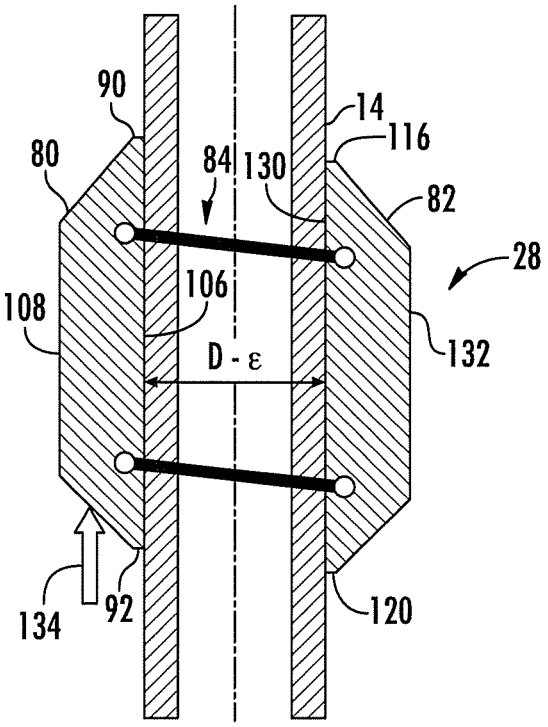
FIG. 8 is another diagrammatic view of the clamp assembly depicted in FIG. 7 showing a self-tightening feature of the clamp assembly when axial stress is applied to one clamp part of the clamp assembly.

As shown in FIGS. 7 and 8, the first clamp part 80 and the second clamp part 82 are linked together by the hinge assembly 84 and the fastener 86 to form a self-tightening action. In a preferred embodiment, the hinge assembly 84 and the fastener 86 link the first clamp part 80 and the second clamp part 82 together to permit movement of one of the first clamp part 80 relative to the second clamp part 82 like a parallelogram to generate the self tightening action when one of the first clamp part 80 and the second clamp part 82 is submitted to an axial load 134. For example, in use the clamp assembly 28 can be dragged inside of a cylindrical hole (e.g., an open hole, casing, liner, or the like) so that only one of the first clamp part 80 and the second clamp part 82 is submitted to the axial load 134 caused by, for example, friction or shocks. The opposite one of the first clamp part 80 and the second clamp part 82 is not in contact with the cylindrical hole and this causes an unequal axial load 134 on the clamp assembly 28. If a dragging force or shock exceeds an adherence limit of the clamp assembly 28, the first clamp part 80, or the second clamp part 82 submitted to the axial force 134 tends to slip along the tubing 14, while the opposite one of the first clamp part 80, and the second clamp part 82 stays in place, due to the design of the clamp assembly 28. The clamp assembly 28 deforms like a parallelogram so that a distance between the first clamp part 80 and the second clamp part 82 is reduced. Consequently, the first clamp part 80 and the second clamp part 82 grip the tubing 14 even tighter when the first clamp part 80 and the second clamp part 82 are subjected to unequal axial forces.

Figure 4B:
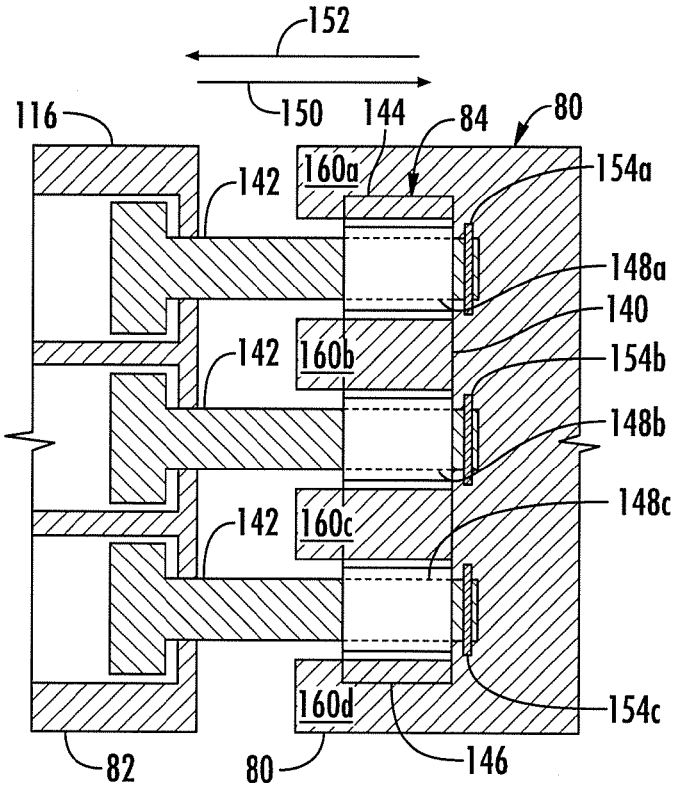
FIG. 4B is a side elevational view of an exemplary hinge assembly.

Shown in FIG. 4B, one example of the hinge assembly 84 is depicted. In general, the hinge assembly 84 is provided with a pin 140, and a plurality of bolts 142 such as threaded bolts which are connected to the pin 140 and movable relative thereto as discussed below. The pin 140 is provided with a first end 144 and a second end 146 and a plurality of a threaded openings 148*a-c*. The pin 140 is preferably cylindrically shaped and constructed of a rigid material such as steel. The bolts 142 are positioned within the threaded openings 148*a-c* and are movable in a first direction 150 generally towards the pin 140, and in a second direction 152 generally away from the pin 140. The hinge assembly 84 can also be provided with a plurality of stop members 154*a-c* connected to the bolts 142, such as a split ring so as to prevent removal of the bolts 142 from the pin 140.

The hinge assembly 84 is connected to the first side 100 of the first clamp part 80. As best shown in FIG. 5, the first side 100 can be configured with a plurality of spaced apart fingers 160*a-d* defining spaces 162*a-c* therebetween. A bore 164 is formed within the first clamp part 80 adjacent to the first side 100 such that the bore 164 extends through the fingers 160*a-d*. The pin 140 is positioned within the bore 164 such that the openings 148*a-c* are aligned with the spaces 162*a-c*.

A plurality of counter bores 166*a-c* are formed within the second clamp part 82 through the second external surface 132 and extend through the third side 124. The counter bores 166*a-c* are sized so as to receive and to capture the bolts 142 so as to prevent removal therefrom except through the counter bores 166*a-c*. To connect the first clamp part 80 to the second clamp part 82, the bolts 142 are positioned through the counter bores 166*a-c* and positioned within the openings 148*a-c*. The bolts 142 are provided with a loose fit within the counter bores 166*a-c*, and between the fingers 160*a-d* so that the pin 140 can move in an axial direction 170 to form the self-tightening action discussed above. The pin 140 can preferably move between 1/32 of an inch to 1/4 of an inch, more preferably between 1/16 of an inch and 3/16 of an inch, and even more preferably about 1/8 of an inch.

An exemplary embodiment of the fastener 86 is shown in FIGS. 5 and 6. The fastener 86 can be constructed similarly as the hinge assembly 84, and in general is provided with one or more devices to removably and preferably non-hingedly connect the second side 102 of the first clamp part 80 to the fourth side 126 of the second clamp part 82 while permitting movement within the axial direction 170 when the second side 102 is connected to the fourth side 126. For example, the fastener 86 can be provided with a pin 172, and a plurality of bolts 174 such as threaded bolts which are connected to the pin 172 and movable relative thereto as discussed below. The pin 172 is provided with a first end 176 and a second end 178 and a plurality of a threaded openings180*a-c*. The pin 172 is preferably cylindrically shaped and constructed of a rigid material such as steel. The bolts 174*a-c* have a shaft 179*a-c* positioned within the threaded openings 180*a-c* and are movable in a first direction 182 generally towards the pin 172, and in a second direction 184 generally away from the pin 172. The fastener 86 can also be provided with a plurality of stop members 188*a-c* (see FIG. 6) connected to the bolts 174, such as a split ring so as to prevent removal of the bolts 174 from the pin 172.

The fastener 86 can be connected to the second side 102 of the first clamp part 80 although the fastener 86 could be connected to the fourth side 126. As best shown in FIG. 5, the second side 102 can be configured with a plurality of spaced apart fingers 192*a-d* defining spaces 194*a-c* therebetween. As shown in FIG. 4A, a bore 196 is formed within the first clamp part 80 adjacent to the second side 102 such that the bore 196 extends through the fingers 192*a-d*. The pin 172 is positioned within the bore 196 such that the openings 180*a-c* are aligned with the spaces 194*a-c*.

A plurality of notches 200*a-c* are formed within the second clamp part 82 through the second external surface 132 and extend into the fourth side 126. The notches 200*a-c* are sized so as to receive the bolts 174 and aligned with the spaces 194*a-c* to permit the shafts 179*a-c* of the bolts 174 to be inserted within the notches 200*a-c* when the clamp assembly 28 is being installed onto the tubing 14. The bolts 174*a-c* have heads 201*a-c* to engage the second clamp part 82 when the bolts 174 are tightened to move the fourth side 126 closer to the second side 102. The bolts 174 are provided with a loose fit within the notches 200*a-c*, and between the fingers 192*a-d* so that the pin 172 can move in the axial direction 170 within the bore 196 to form the self-tightening action discussed above. The pin 172 can preferably move between 1/32 of an inch to 1/4 of an inch, and more preferably between 1/16 of an inch and 3/16 of an inch, and even more preferably about 1/8 of an inch. The term "about" as used herein refers to manufacturing tolerances and means within 10% of a predetermined value.

Figure 9:
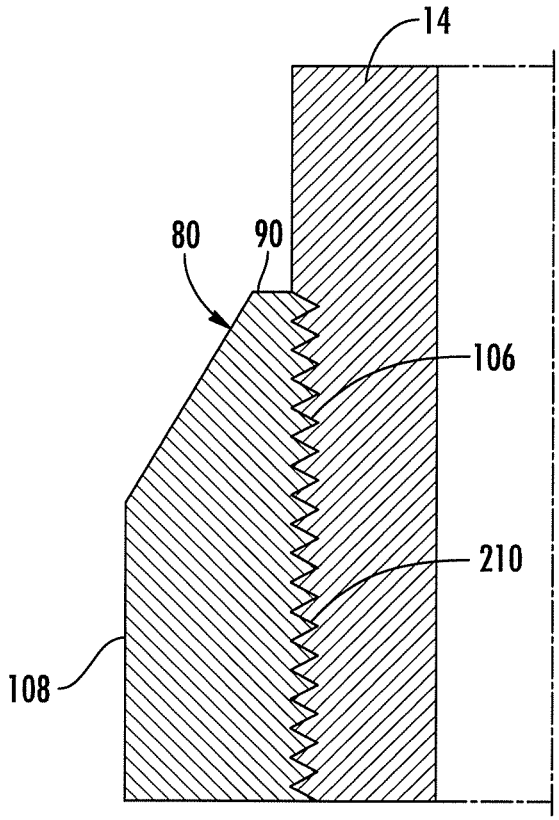
FIG. 9 is a cross-sectional diagram of a version of the clamp assembly mounted to the tubing showing teeth of an inner clamp surface of the clamp assembly gripping the tubing.

Shown in FIG. 9 is a cross-sectional diagram of a version of the clamp assembly 28 mounted to the tubing 14. To increase the grip of the clamp assembly 28 on the tubing 14, the first inner clamp surface 106 and/or the second inner clamp surface 130 can be roughed, or abraded rather than being a smooth surface. For example, as shown in FIG. 9, the first inner clamp surface 106 includes a plurality of teeth 210, only one of which is labeled for purposes of clarity. The teeth 210 are preferably symmetric to resist movement in both axial directions. Preferably, the first clamp part 80 and the second clamp part 82 are constructed of a material that is harder than the tubing 14 so that the teeth 210 will bite into the tubing 14 when the clamp assembly 28 is installed to form a shear coupling between the clamp assembly 28 and the tubing 14. Alternatively, the teeth 210 can be hardened by applying a surface finish such as a nitriding or carburizing treatment. The teeth 210 can be formed with a variety of sizes and depths. The depth of the teeth 210 is preferably greater than surface imperfections of the tubing 14, such as rust. The size of the teeth 210 can be varied, and an exemplary size is 20 teeth/inch. The teeth 210 can be formed using any suitable method, such as cutting a triangular thread on the first and second inner clamp surfaces 106 and 130.

Figure 10:
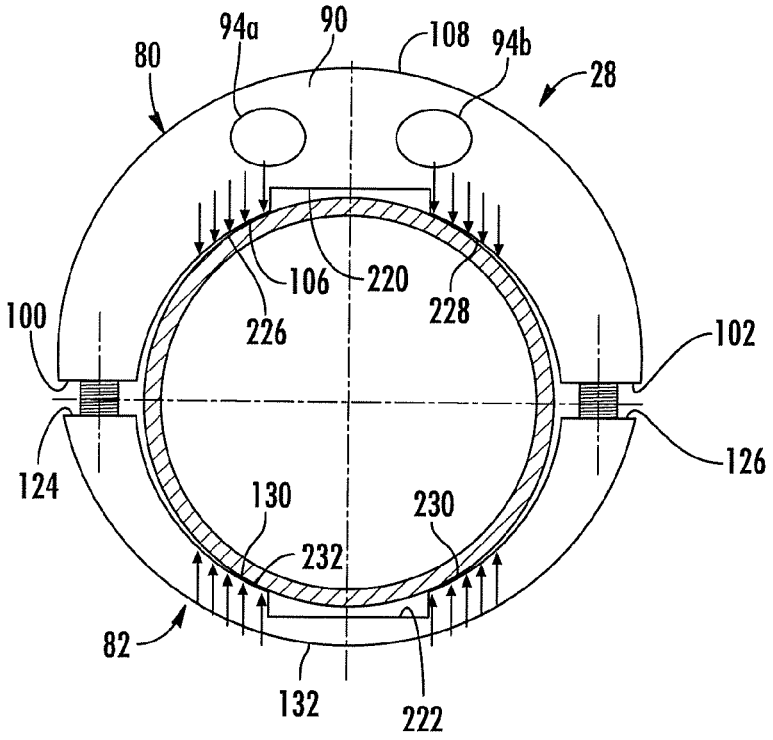
FIG. 10 is a top plan view of another version of the clamp assembly mounted onto a section of the tubing (shown in cross-section) illustrating slots formed in the inner clamp surfaces of the clamp parts depicted in FIG. 5 defining at least two contact locations between each clamp part and the tubing.

FIG. 10 is a top plan view of the clamp assembly 28 mounted onto a section of the tubing 14 (shown in cross-section) illustrating a first slot 220 and a second slot 222. The first slot 220 is formed in the first inner clamp surface 106 and extends between the first end 90 and the second end 92. The second slot 222 is formed in the second inner clamp surface 130 and extends between the third end 116 and the fourth end 120. As discussed above, the tolerance on a diameter of the tubing 14 is rather large. To accommodate the tolerance, the internal diameter of the first and second inner clamp surfaces 106 and 130 should be equal to or greater than the largest pipe diameter. The first and second slots 220 and 222 serve to divide the first and second inner clamp surfaces 106 and 130 into clamp zones 226, 228, 230 and 232, which spreads the clamping force over a larger area thereby increasing the stability of the clamp assembly 28 on the tubing 14, as well as reducing deformation of the tubing 14 due to the clamp force. The size of the first and second slots 220 and 222 can be larger or smaller than that shown in FIG. 10, and the location of the first and second slots 220 and 222 can be changed. The slot 220 is desirably positioned between the connections 94*a* and 94*b* to position the clamp zones 226 and 228 in close proximity to the connections 94*a* and 94*b*. The term close proximity, as used herein, refers to a distance less than ½ inch, and more preferably about ⅜ inch.

Figure 11:
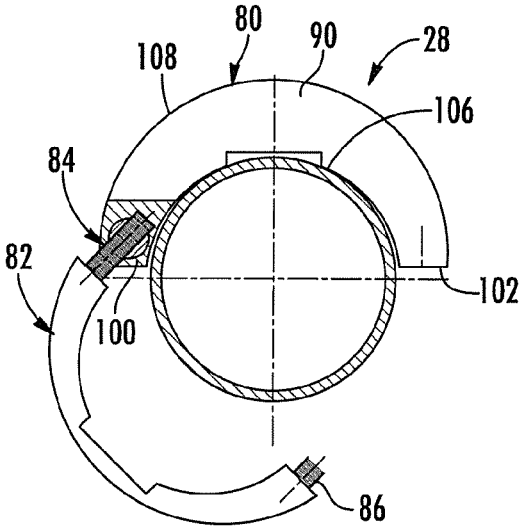
FIG. 11 is a fragmental, top plan view of the clamp assembly being installed on the tubing showing a hinge assembly constructed in accordance with the present disclosure.
Figure 12:
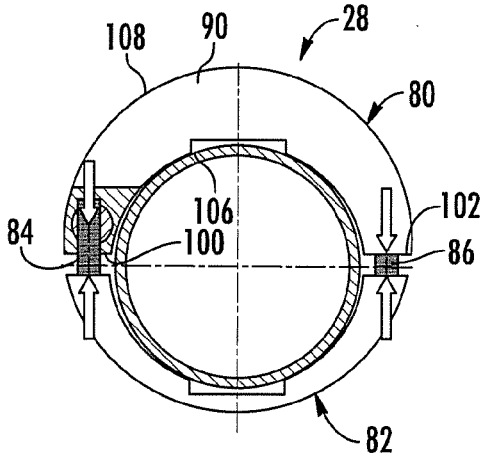
FIG. 12 is another fragmental, top plan view of the clamp assembly depicted in FIG. 11 in which the clamp assembly is installed on the tubing with arrows showing force being exerted on the clamp parts by adjustment of the hinge assembly and the fastener.

FIG. 11 is a fragmental, top plan view of the clamp assembly 28 being installed on the tubing 14 showing the hinge assembly 84 constructed in accordance with the present disclosure. In particular, the bolts 142 and 174 are loosened and then the bolts 174 of the fastener 86 are removed from the notches 200 so that the clamp assembly 28 can be opened as shown in FIG. 11. Then, the clamp assembly 28 is placed on the tubing 14 as shown in FIG. 11, and the bolts 174 are positioned within the notches 200 as shown in FIG. 12. The bolts 142 and 174 can then be tightened, which applies force to the first clamp part 80 and the second clamp part 82 as shown by the arrows 240, 242, 244 and 246 in FIG. 12.

Although only a few embodiments of the present invention have been described in detail above, those of ordinary skill in the art will readily appreciate that many modifications are possible without materially departing from the teachings of the present invention. Accordingly, such modifications are intended to be included within the scope of the present invention as defined in the claims.

What is claimed is:

1. A clamp assembly for connecting at least one downhole tool to a tubing in a well, the tubing having an exterior surface, the clamp assembly comprising:

a first clamp part having a first end and a second end, the first end having at least one connection capable of receiving and securing the at least one downhole tool, the first clamp part having a first side and a second side extending between the first end and the second end, the first clamp part having a first inner clamp surface extending between the first side and the second side, and a first external surface extending between the first side and the second side;

a second clamp part having a third end, a fourth end, a third side, and a fourth side with the third side and the fourth side extending between the third end and the fourth end, the second clamp part also having a second inner clamp surface extending between the third side and the fourth side, and a second external surface extending between the third side and the fourth side;

a hinge assembly connecting the first side to the third side and configured to permit the first clamp part and the second clamp part to be moved to a closed position where the second side is positioned adjacent to the fourth side and an open position where the second side and the fourth side are spaced a distance apart to receive the tubing;

a fastener connecting the second side to the fourth side when the first clamp part and the second clamp part are in the closed position;

wherein, the first inner clamp surface and the second inner clamp surface are sized and dimensioned to grip the exterior surface of the tubing when the first clamp part and the second clamp part are in the closed position; and wherein the hinge assembly and the fastener are adapted to permit longitudinal movement between 1/32 of an inch and ¼ of an inch of the first clamp part relative to the second clamp part to form a self-tightening action when the first clamp part and second clamp part are in the closed position.

2. The clamp assembly of claim 1, wherein the first clamp part includes a bore extending between the first end and the second end, and wherein the hinge assembly includes a pin positioned within the bore and a plurality of bolts connecting the pin to the third side.

3. The clamp assembly of claims 1 wherein the first side defines a plurality of fingers forming a space between each adjacent pair of fingers to form a series of fingers and spaces, and wherein a plurality of bolts are positioned within the spaces.

4. The clamp assembly of claims 1, wherein the first side defines a plurality of fingers forming a space between each pair of fingers to form a series of fingers and spaces and wherein the third side includes a series of counter-bores with each counter-bore being aligned with one of the spaces.

5. The clamp assembly of claims 1, wherein the first inner clamp surface includes a slot extending between the first end and the second end to form a first clamp zone and a second clamp zone.

6. The clamp assembly of claim 5, wherein the connection is in close proximity to the first clamp zone.

7. The clamp assembly of claims 1, wherein the second inner clamp surface includes a slot extending between the third end and the fourth end.

8. The clamp assembly of claims 1, wherein the first inner clamp surface includes a plurality of teeth extending in a direction from the first side to the second side wherein the teeth are projections adapted to cut into the tubing to form a shear coupling between the first inner clamp surface and the tubing.

9. The clamp assembly of claims 1, wherein the second inner clamp surface includes a plurality of teeth extending in a direction from the third side to the fourth side wherein the teeth are projections adapted to cut into the tubing to form a shear coupling between the second inner clamp surface and the tubing.

10. The clamp assembly of claim 1, wherein the hinge assembly includes a plurality of first bolts connecting the first side to the third side, and wherein the fastener includes a plurality of second bolts connecting the second side to the fourth side when the first clamp part and the second clamp part are in the closed position.

11. The clamp assembly of claims 1, wherein the first external surface of the first clamp part and the second external surface of the second clamp part are sized such that the first clamp part and the second clamp part fit within a downhole casing when the first clamp part and the second clamp part are in the closed position.

12. An apparatus, comprising:

a downhole tool having a first end and a second end;

two clamp assemblies with a first one of the clamp assemblies connected to the first end of the downhole tool and a second one of the clamp assemblies connected to the second end of the downhole tool, the first one and the second one of the clamp assemblies comprising:

a first clamp part having a first end, a second end, a first side and a second side with the first side and the second side extending between the first end and the second end, the first clamp part having a first inner clamp surface extending between the first side and the second side, and a first external surface extending between the first side and the second side;

a second clamp part having a third end, a fourth end, a third side, and a fourth side with the third side and the fourth side extending between the third end and the fourth end, the second clamp part also having a second inner clamp surface extending between the third side and the fourth side, and a second external surface extending between the third side and the fourth side;

a hinge assembly connecting the first side to the third side and configured to permit the first clamp part and the second clamp part to be moved to a closed position where the second side is positioned adjacent to the fourth side and an open position where the second side and the fourth side are spaced a distance apart to receive a tubing;

a fastener connecting the second side to the fourth side when the first clamp part and the second clamp part are in the closed position;

wherein, the first inner clamp surface and the second inner clamp surface are sized and dimensioned to grip an exterior surface of a tubing positionable within a well when the first clamp part and the second clamp part are in the closed position; and wherein the hinge assembly and the fastener are adapted to permit longitudinal movement between 1/32 of an inch and 1/4 of an inch of the first clamp part relative to the second clamp part to form a self-tightening action when the first clamp part and second clamp part are in the closed position.

13. The apparatus of claim 12, wherein the first clamp part and the second clamp part are in the closed position and wherein the apparatus further comprises a tubing positioned between the first clamp part and the second clamp part.

14. The apparatus of claim 13, wherein the downhole tool is spaced a distance away from the tubing.

15. The apparatus of claim 14, wherein the downhole tool includes an acoustic modem.

16. A method of connecting a downhole tool to a tubing within a well, comprising the steps of:

connecting two clamp assemblies as defined in claim 1 to opposite ends of the downhole tool with the connections in the first clamp parts; and connecting the two clamp assemblies to an exterior surface of the tubing.

17. A method of making a clamp assembly, comprising:

connecting a first side of a first clamp part to a third side of a second clamp part via a hinge assembly adapted to permit longitudinal movement of the first clamp part relative to the second clamp part between 1/32 of an inch and 1/4 of an inch when the first clamp part and second clamp part are in a closed position, the first clamp part and the second clamp part defining first and second inner clamp surfaces sized and adapted to grip a tubing within a well; and connecting a fastener to a second side of the first clamp part, the fastener configured to connect the second side of the first clamp part to a fourth side of the second clamp part to permit longitudinal movement between 1/32 of an inch and 1/4 of an inch of the first clamp part relative to the second clamp part when the first clamp part and second clamp part are in the closed position.

18. The method of claim 17, wherein the first clamp part includes a bore extending between a first end and a second end, and wherein the step of connecting the first side of the first clamp part to the third side of the second clamp part includes the steps of positioning a pin within the bore and connecting a plurality of bolts to the pin.

19. The method of claim 17, wherein the first side defines a plurality of fingers forming a space between each adjacent pair of fingers to form a series of fingers and spaces, and wherein a plurality of bolts are positioned within the spaces.

20. The method of claim 19, further comprising the step of forming a series of counter-bores in the second clamp part with each of the counter-bores being aligned with one of the spaces.

21. The method of claim 17, further comprising the step of forming a slot in the first inner clamp surface extending between a first end and a second end to form a first clamp zone and a second clamp zone.

22. The method of claim 21, further comprising the step of forming a slot in the second inner clamp surface extending between a third end and a fourth end to form a third clamp zone and a fourth clamp zone.

* * * * *